US005486667A

United States Patent [19]

Castonguay et al.

[11] Patent Number: 5,486,667

[45] Date of Patent: Jan. 23, 1996

[54] RATING MODULE UNIT FOR HIGH AMPERE-RATED CIRCUIT BREAKER

[75] Inventors: Roger N. Castonguay, Terryville; James L. Rosen, West Hartford; Mark A. Zaffetti, Windsor Locks, all of Conn.

[73] Assignee: General Electric Company, New York, N.Y.

[21] Appl. No.: 203,062

[22] Filed: Feb. 28, 1994

[51] Int. Cl.[6] ..... H01H 5/00

[52] U.S. Cl. ..... 200/400; 200/453; 267/168

[58] Field of Search ..... 200/400, 401, 200/453, 457, 459, 321, 325; 267/168, 169, 170, 172, 177; 74/97.1

[56] References Cited

U.S. PATENT DOCUMENTS 2,581,181 1/1952 Favre .
3,944,196 3/1976 Schwartzkopf ..... 267/168
4,001,742 1/1977 Jencks et al. .
4,713,508 12/1987 Baginski et al. ..... 200/321
4,801,907 1/1989 Kelaita, Jr. et al. .

OTHER PUBLICATIONS

Castonguay et al "Operating Mechanism for High Ampere–Rated Circuit Breakers"; U.S. Serial No: 08/202140.

*Primary Examiner*—Henry J. Recla
*Assistant Examiner*—David J. Walczak
*Attorney, Agent, or Firm*—Richard A. Menelly

[57] ABSTRACT

This invention relates to a high ampere-rated circuit breaker which meets the electrical code requirements of the world market. The operating springs controlling the CLOSED state of the circuit breaker contacts are contained within a module unit which can be installed both in the field as well as in the factory. A separate module provides the spring bias forces required for each of the circuit breaker ampere ratings.

7 Claims, 6 Drawing Sheets

10

RATING MODULE UNIT FOR HIGH AMPERE-RATED CIRCUIT BREAKER

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

U.S. patent application Ser. No. 08/202,140 filed on Feb. 25, 1994 entitled "OPERATING MECHANISM FOR HIGH AMPERE-RATED CIRCUIT BREAKERS" describes an operating mechanism capable of immediately resetting the circuit breaker operating mechanism to reclose the contacts without having to recharge the circuit breaker operating springs immediately after opening the circuit breaker contacts.

Since the operating springs within the operating mechanism assembly are increased in force as the ampere ratings are increased to account for the higher opening and closing requirements of the circuit breaker contacts with the increased circuit current, the circuit breaker springs are usually custom-installed at the factory during the assembly of the operating mechanism components.

It would be economically advantageous to employ a common operating mechanism assembly for each of the various ampere ratings and provide a separate arrangement for assembling the operating springs without disturbing the operating mechanism assembly.

An earlier attempt to vary the circuit breaker operating springs according to the circuit breaker requirements is found in U.S. Pat. No. 4,713,508. The patent addresses the problems involved with adding the operating springs in their "charged" or compressed condition to the operating mechanism assembly at the point of manufacture.

One purpose of this invention accordingly, is to provide an arrangement whereby the circuit breaker operating springs are contained within a separate unit from the operating mechanism and can be installed within the circuit breaker enclosure without disturbing the operating mechanism assembly.

SUMMARY OF THE INVENTION

A circuit breaker operating mechanism spring modular unit contains the circuit breaker operating springs independent from the operating mechanism assembly. The modular unit is later installed either at the point of assembly or at the installation site without disturbing the operating mechanism components. Each module contains the requisite number and arrangement of springs to meet the spring bias force requirements for each circuit breaker ampere rating.

DESCRIPTION OF THE PREFERRED EMBODIMENT

Figure 1:
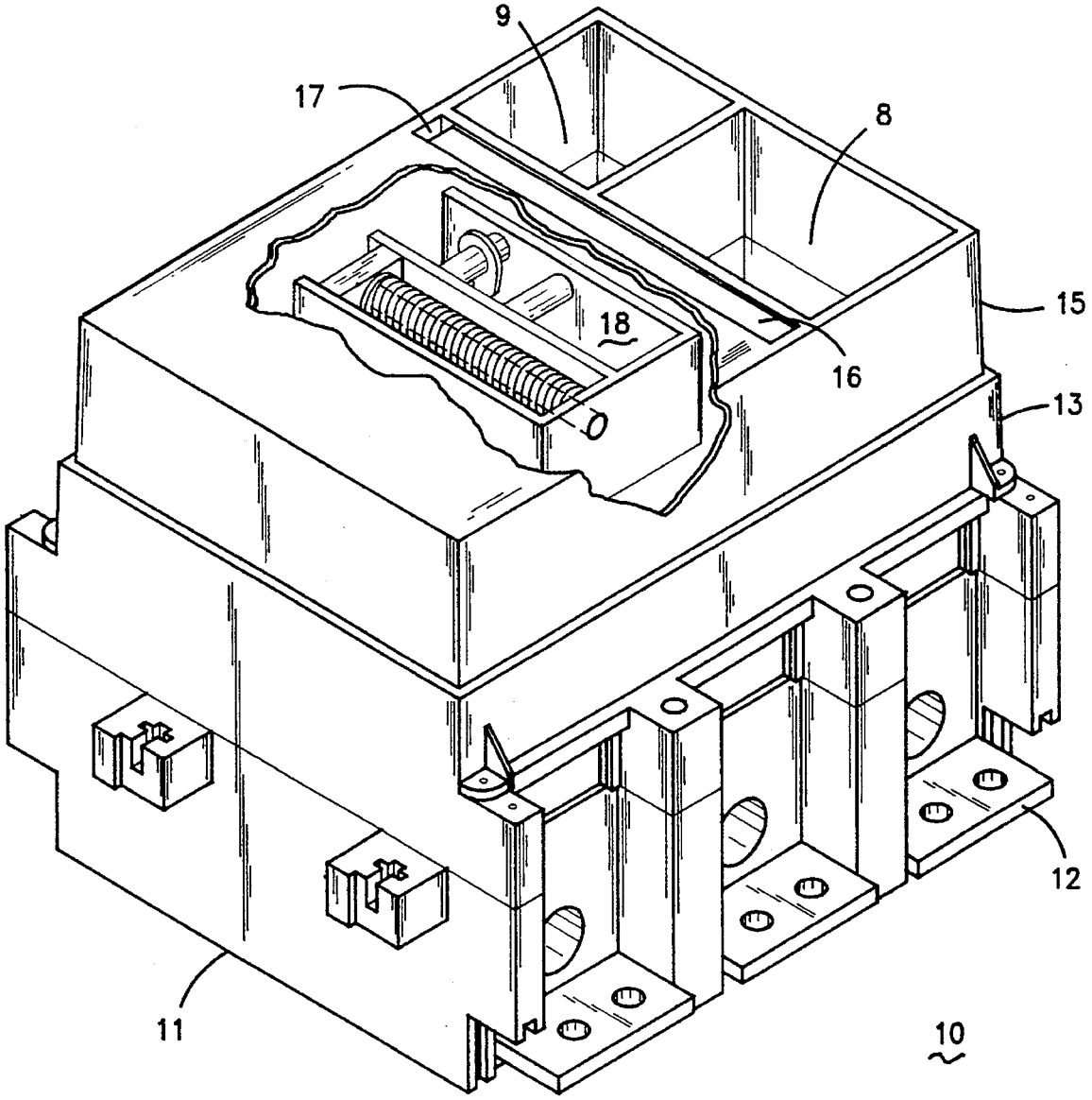
FIG. 1 is a top perspective view of a high ampere-rated circuit breaker with a portion of the circuit breaker cover removed to depict the operating spring modular unit according to the invention.
Figure 2:
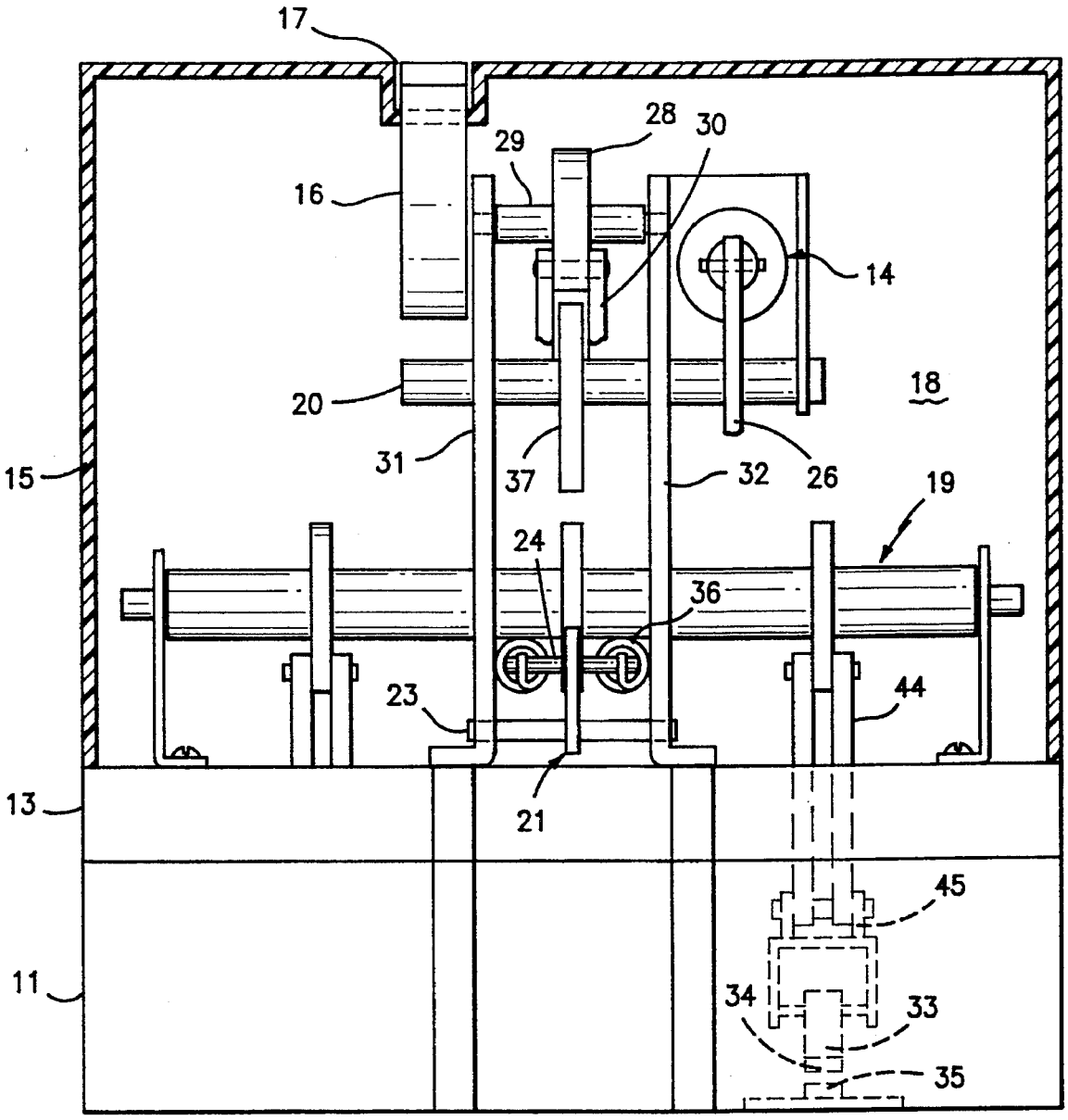
FIG. 2 is an end view of the circuit breaker of FIG. 1 with the end part of the cover removed to show the positional relationship of the operating mechanism components.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 13 of similar insulative material is attached prior to attaching the top cover 15, also consisting of an electrically-insulative material. Electrical connection with the interior current-carrying components is made by load terminal straps 12 extending from one side of the base and line terminal straps (not shown) extending from the opposite side thereof. The interior components are controlled by an electronic trip unit contained within a recess 8 on the top surface of the top cover 15. Although not shown herein, the trip unit is similar to that described within U.S. Pat. No. 2,581,181 and interacts further with an accessory contained within the accessory recess 9 to provide a range of protection and control functions such as described, for example within U.S. Pat. No. 4,801,907. The operating handle 16 located within the handle recess 17 allows manual operation of the circuit breaker operating mechanism 18 to separate the circuit breaker movable and fixed contacts 34, 35 as best seen by now referring to the circuit breaker 10 shown in FIG. 2.

The operating handle 16 extends within the recess 17 along one of the sideframes 31, 32 and interacts with the closing shaft 20 which extends between the sideframes. The cradle 28 is supported on the cradle pivot 29 and interconnects with the closing cam 37 on the closing shaft 20 by means of the cradle links 30. The crank 26 extending from the closing shaft 20 connects with the operating spring modular unit 14 to rotate the drive shaft 19 and move the contact arm drive link 44, contact arm carrier 45 and contact arm 33 into the CLOSED condition with the movable contact 34 in abutment with the fixed contact 35. The interface cam 21 includes the spring support pin 24 that positions and supports a pair of opening springs 36 to rotate the interface cam 21 about the pivot pin 23 to rotate the drive shaft 19 and lift the contact arm drive link 44, contact arm carrier 45 and contact arm 33 to drive the moveable contact 34 away from the fixed contact 35. Although only one pair of moveable and fixed contacts are depicted, there is a similar pair of such contacts for each circuit breaker pole contained within the circuit breaker case 11. The contacts and other current-carrying components are contained within the circuit breaker case and are insulated from the operating mechanism components within the top cover 15 by means of the electrically-insulating intermediate cover 13.

Figure 3:
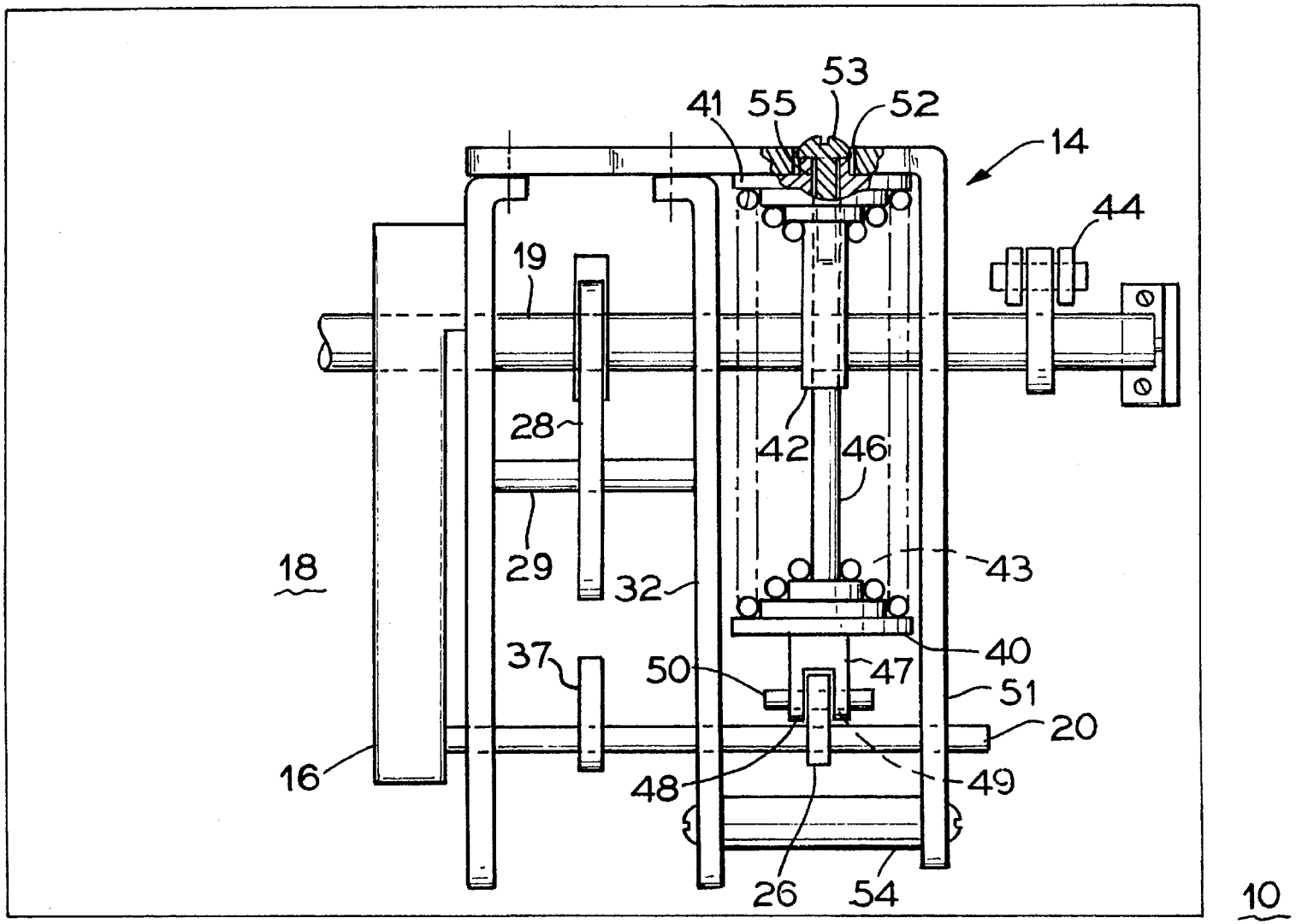
FIG. 3 is a top plan view of the circuit breaker of FIG. 2 with the top part of the cover removed to depict the operating spring modular unit relative to the circuit breaker operating unit.

The location of the spring module unit 14 relative to the operating handle 16 and drive shaft 19 is shown in FIG. 3. The operating mechanism 18 is depicted from the top of the circuit breaker 10 and with the spring module unit 14 attached to the L-shaped sideframe 51 by means of the torquing screw 53 extending through the sideframe opening 52 by means of an interface bushing 55. The rear concentric cylinder 41 abuts against the sideframe 51 while the front concentric cylinder 40 connects with the crank 26 by capturing the crank within the slot 48 formed within the connector stud 47 and inserting the locking pin 50 through the thru-hole 49 formed in the crank. The closing springs 43 are supported between the front and rear concentric cylinders 40,41 upon the support rod 46 and the cylindrical extension 42 extending from the rear concentric cylinder 41. The energy-absorbing block 54 extending between the operating mechanism sideframe 32 and the spring module unit sideframe 51 serves the function of absorbing excess closing spring forces that occur when the operating mechanism "crashes" by attempting to close the circuit breaker contacts when the cradle 28 is not engaged with the latch assembly, described within the aforementioned U.S. Patent Application. The location of the block relative to the closing springs is an important feature of the invention since the excessive spring forces are thereby shunted away from the operating mechanism components and accordingly protects such components from damage. The material for the block can be selected to minimize the impact caused by the excessive spring forces. Steel material with silicone rubber coatings and other plastic like compositions add to the shock-adsorbing properties. The interaction between the drive shaft 19, cradle 28 and cradle pivot 29 with closing cam 37 and the closing shaft 20 is also described therein.

Figure 4:
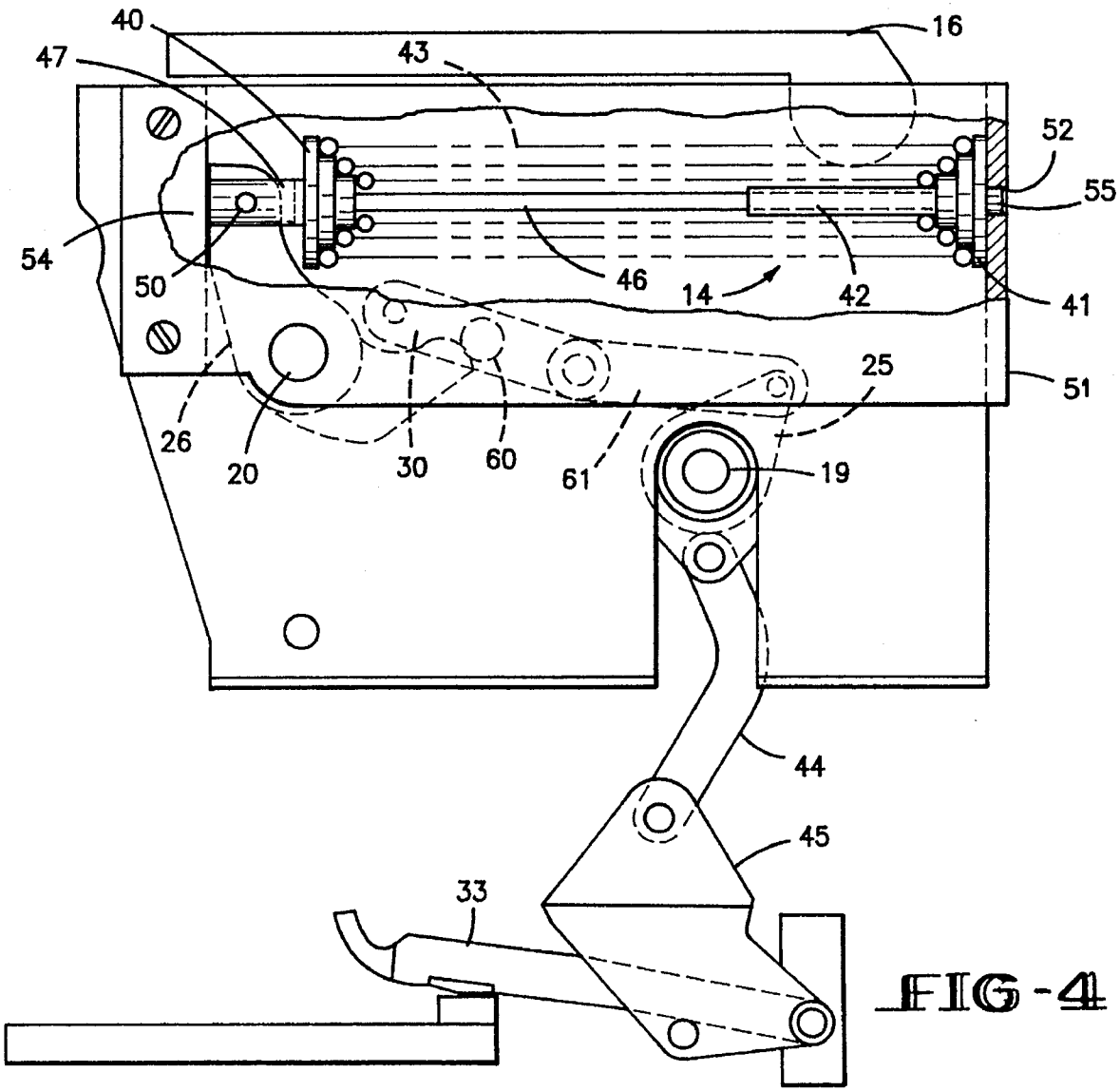
FIG. 4 is partial side view of the circuit breaker of FIG. 1 depicting the arrangement of the operating spring modular unit relative to the circuit breaker movable contact arm.

The location of the spring module unit 14 relative to the operating handle 16 and the movable contact arm 33 is shown in FIG. 4. The energy stored within the closing springs 43 is exerted on the crank 26 and the closing shaft 20 via the cradle link 30, roller 60 and drive link 61. The energy transfers to the drive shaft 19 by means of the crank 25 and from the drive shaft to the contact arm carrier 45 and contact arm 33.

Figure 5:
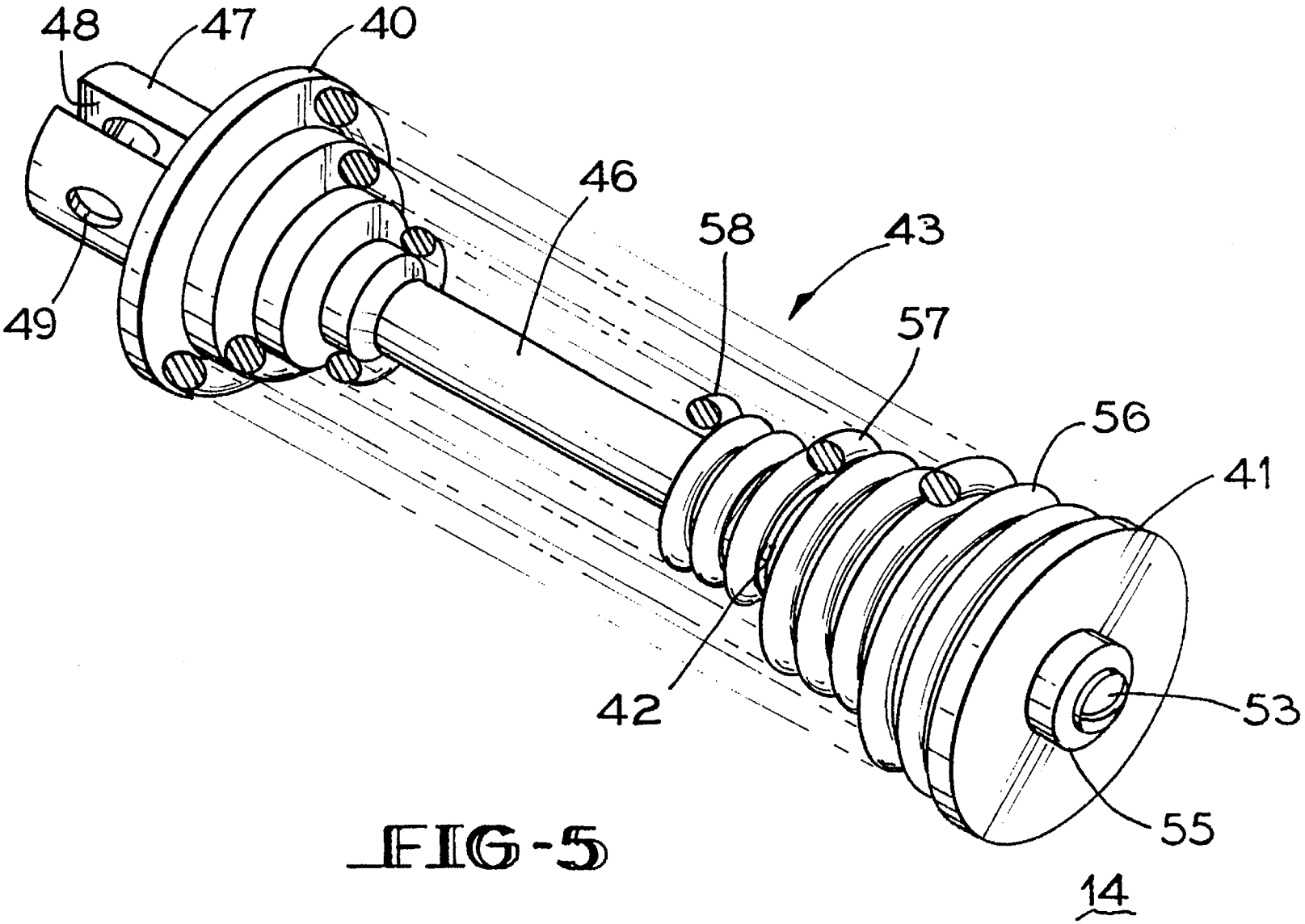
FIG. 5 is a front perspective view of the operating spring mounting assembly used within the operating spring modular unit of FIG. 1.
Figure 6:
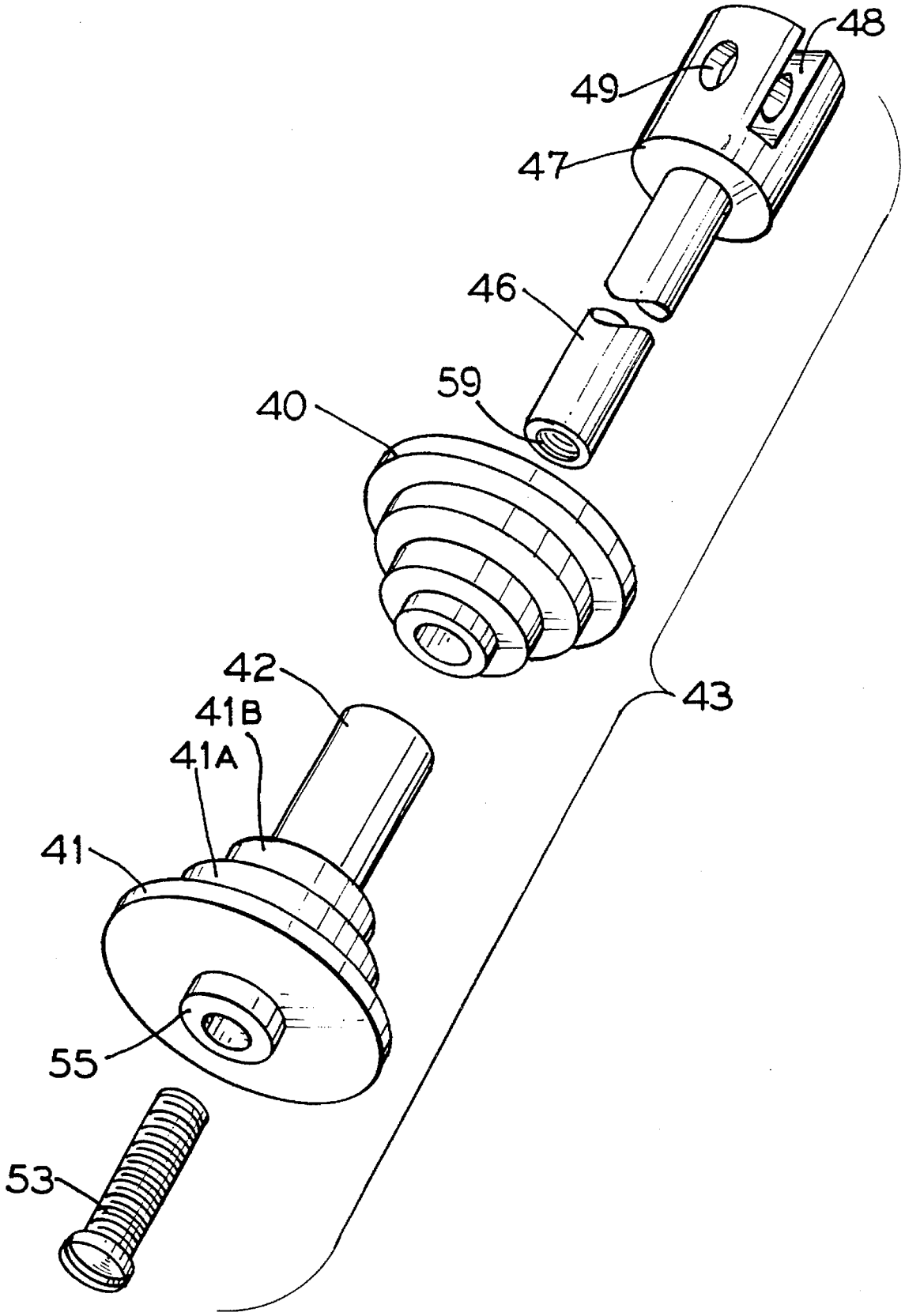
FIG. 6 is a top perspective view in isometric projection of the components used with the operating spring mounting assembly of FIG. 5.

The closing spring assembly 43 is shown in FIG. 5 with three springs 56, 57, 58 arranged concentrically between the front and rear concentric cylinders 40, 41 and assembled upon the support rod 46 and cylindrical extension 42. The connector stud 47 is formed from the same metal stock as the support rod 46 to provide extra strength to the spring assembly. The slot 48 in the connector stud along with the thru-hole 49 allow for connection within the circuit breaker operating mechanism in the manner described earlier. As described within the aforementioned U.S. Pat. No. 4,713,508 some means is required to hold the closing springs in their compressed state before inserting the closing springs within the circuit breaker operating mechanism. This is accomplished as seen by referring now to both FIGS. 5 and 6. The closing force requirements are first determined for the particular circuit breaker ampere rating and the appropriate number of closing springs 57–58 are selected. The closing springs are then arranged over the cylindrical extension 42 such that the closing spring 56 nests on the cylinder 41A, closing spring 57 nests on the cylinder 41B and closing spring 58 nests on the cylinder extension 42 on the rear concentric cylinder 41. Similar cylinders are arranged on the front concentric cylinder 40 for the opposite ends of the closing springs to nest. With the support rod 46 inserted through the concentric cylinders 40,41 and the connector stud in abutment against the front concentric cylinder, the torquing screw 53 is inserted within the thread 59 of the support rod 46. Threading the torquing screw 53 within the bushing 55 takes up the bias exerted against the opposing front and rear concentric cylinders 40,41. When the closing spring assembly 43 is later inserted within the closing spring modular unit 14 of FIG. 3, the torquing screw 53 is removed from the bushing 55 allowing the compressed closing springs to exert their biasing force against the crank 26.

The bushing 55 further serves to precisely position and align the closing spring assembly within the spring module unit 14 by captivating the bushing within the corresponding side frame opening 52 as shown earlier in FIG. 4.

It is noted that the insertion and removal of the closing spring modular unit is made from the top of the circuit breaker without disturbing the other circuit breaker components. This not only allows both field as well as factory installation, but also allows removal and replacement facility to installed units without requiring dismantling of the circuit breaker internal components.

We claim:

1. An industrial-rated circuit breaker for high-level overcurrent protection comprising:

an insulative base;

a pair of separable contacts within said base, one of said contacts being attached to a movable contact arm;

a contact arm carrier connecting with said movable contact arm within said base and with a contact arm drive link extending outside said base;

an insulative cover above said base, said cover enclosing a closing shaft and a drive shaft, said drive shaft connecting with said contact arm drive link for moving said contact arm carrier and said contact arm between open and closed positions;

a closing spring modular unit interacting with said closing shaft for providing closing bias force to said closing shaft;

said modular unit comprises:

a pair of front and rear opposing cylinders, one of said cylinders including a cylindrical extension;

a support rod removably connecting said cylinders, one end of said support rod extends within said cylindrical extension, said one end of said support rod being threaded;

a compression spring arranged on said support rod;

means on one of said cylinders providing connection with a circuit breaker operating mechanism; and an interface cam interacting with said drive shaft for controlling when said drive link moves said contact arm between said open and closed positions.

2. The closing spring modular unit of claim 1 further including a torquing screw removably attached to said threaded end of said support rod for controllably retaining said compression spring intermediate said front and rear cylinders.

3. The industrial-rated circuit breaker of claim 1 wherein said front cylinder includes a plurality of cylindrical extensions extending from one side thereof.

4. The industrial-rated circuit breaker of claim 1 wherein said means providing connection comprises a connector stud.

5. The industrial-rated circuit breaker of claim 1 including additional closing springs inserted within said closing spring.

6. A method of assembling compressed closing springs for use within a circuit breaker operating mechanism comprising the steps of:

providing front and rear cylinders, said rear cylinder including a cylinder extension; inserting a support rod through a central part of said front cylinder;

arranging a closing spring on said support rod, said support rod including a first end having threads and a second end having a connector stud; and inserting a torquing screw within said threaded end to compress said closing spring between said front and rear cylinders to form a unitary closing spring assembly.

7. The method of claim 6 including the steps of:

engaging said connector stud with a circuit breaker operating mechanism 18; and removing said torquing screw from said threaded end to thereby charge said circuit breaker operating mechanism.

* * * * *